US006933912B2

(12) United States Patent
Chang et al.

(10) Patent No.: US 6,933,912 B2
(45) Date of Patent: Aug. 23, 2005

(54) OPERATION VOLTAGE AUTO-ADJUSTABLE ACTIVE MATRIX ORGANIC LIGHT EMITTING DIODE CIRCUIT AND AUTO-ADJUSTING METHOD THEREOF

(75) Inventors: Yi-Chen Chang, Taipei (TW); Shuohsiu Hu, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 22 days.

(21) Appl. No.: 10/604,839

(22) Filed: Aug. 21, 2003

(65) Prior Publication Data

US 2004/0178740 A1 Sep. 16, 2004

(30) Foreign Application Priority Data

Mar. 10, 2003 (TW) ..... 92105112 A

(51) Int. Cl.[7] ..... G09G 3/32

(52) U.S. Cl. ..... 345/82; 345/76; 345/55; 315/169.3

(58) Field of Search ..... 345/92, 90, 82–84, 345/76, 55; 315/169.3, 169.4

(56) References Cited

U.S. PATENT DOCUMENTS

| | | | | |
|---|---|---|---|---|
| 6,778,151 | B2 * | 8/2004 | Li | 345/55 |
| 2002/0030647 | A1 * | 3/2002 | Hack et al. | 345/82 |
| 2003/0020413 | A1 * | 1/2003 | Oomura | 315/169.3 |
| 2003/0095087 | A1 * | 5/2003 | Libsch et al. | 345/82 |
| 2003/0155866 | A1 * | 8/2003 | Iwata et al. | 315/149 |
| 2004/0051690 | A1 * | 3/2004 | Chang | 345/92 |

* cited by examiner

*Primary Examiner*—Tuyet Thi Vo
(74) *Attorney, Agent, or Firm*—Jiang Chyun IP office

(57) ABSTRACT

An operation voltage auto-adjustable circuit for active matrix organic light emitting diode ("AMOLED") and an auto-adjusting method thereof is provided. The circuit for automatically adjusting a operation voltage of an AMOLED includes a display panel of an AMOLED having a terminal of an organic light emitting diode ("OLED"); and an auto-adjusting circuit connected to the terminal of the OLED, wherein a current passing through the terminal of the OLED is detected by the auto-adjusting circuit, and a voltage applied to the terminal of the OLED is adjusted by the auto-adjusting circuit according to the current detected. Therefore the current passing through the terminal of the OLED is sensed to automatically adjust the voltage applied thereto, and the current passing through the terminal of the OLED is stably maintained.

5 Claims, 4 Drawing Sheets

OPERATION VOLTAGE AUTO-ADJUSTABLE ACTIVE MATRIX ORGANIC LIGHT EMITTING DIODE CIRCUIT AND AUTO-ADJUSTING METHOD THEREOF

CROSS REFERENCE TO RELATED APPLICATIONS

This application claims the priority benefit of Taiwan application serial no. 92105112, filed on Mar. 10, 2003.

BACKGROUND OF INVENTION

1. Field of the Invention

The invention generally relates to an active matrix organic light emitting diode ("AMOLED") circuit. More particularly, the present invention relates to an operation voltage auto-adjustable AMOLED circuit and auto-adjusting method thereof.

2. Description of the Related Art

With the advancement of communications technology, devices such as computers, workstations, mobile phones, personal digital assistants (PDA), and digital cameras are improved on a daily basis. A display device is essential in each of the devices. In recent years, flat panel display (FPD) is commonly used because of its limited dimension, lightweight, and electricity saving features.

Among varieties of FPD, since active matrix organic light emitting diode (AMOLED) possesses a wider viewing angle, good color contrast, lightweight, thinner structure, high response speed and low cost, thus AMOLED is applicable to portable image devices such as notebooks, PDAs and mobile phones, and especially can be used in large size displays such as televisions and monitors.

However, as in the diagram shown in FIG. 1, the threshold voltage Vth of the thin film transistor (TFT) used in the driving circuit of the AMOLED will increase with usage time, due to the capacitance of the driving circuit. The result is the increase of the thin film transistor's threshold voltage Vth. In saturation region, a current Id passing through an organic light emitting diode (OLE) can be described by the following equation:

$$Id=(½)k(Vgs-Vth)(Vgs-Vth) \quad (1)$$

Therefore, the current Id passing through an OLED will decrease as the threshold voltage Vth of the TFT increases, the performance of the brightness of the OLED is reduced, and thus the lifetime of the device is reduced.

SUMMARY OF INVENTION

Accordingly, the purpose of the present invention is to provide an operation voltage auto-adjustable AMOLED circuit and auto-adjusting method thereof, in which the current passing through the terminal of the OLED is sensed to automatically adjust the voltage applied thereto. Therefore the current passing through the terminal of the OLED is stably maintained.

In order to achieve the above objects and other advantages of the present invention, an embodiment of an operation voltage auto-adjustable AMOLED circuit is provided. The circuit for automatically adjusting an operation voltage of an active matrix organic light emitting diode includes a display panel of an AMOLED having a terminal of an OLED; and an auto-adjusting circuit connected to the terminal of the OLED, in which a current passing through the terminal of the OLED is detected by the auto-adjusting circuit, and a voltage apply to the terminal of the OLED is adjusted by the auto-adjusting circuit according to the current detected. Therefore the current passing through the terminal of the OLED is stably maintained.

In a preferred embodiment of the present invention, the auto-adjusting circuit includes a resistor, a subtracting circuit, a comparing circuit and a digital processor. The resistor is provided for generating a sensing voltage according to the detected current of the terminal of the OLED. The subtracting circuit connected to the resistor is provided for computing a voltage difference between the sensing voltage and the voltage applied to the terminal of the OLED. The comparing circuit is provided for comparing the voltage difference with a reference voltage in order to provide a control signal. And the digital processor connected to the comparing circuit is provided for automatically adjusting the voltage applied to the terminal of the OLED according to the control signal.

In an embodiment of the present invention, the resistance of the resistor is less than about 10 ohm.

In an embodiment of the present invention, the reference voltage is computed according to a standard value of the current passing through the terminal of the OLED.

Another embodiment of the present invention of a method for automatically adjusting an operation voltage of an AMOLED is provided. The method includes sensing the current of the terminal of a OLED; and adjusting the voltage applied to the terminal of the OLED according to the sensed current of the terminal of the OLED automatically. Therefore the current passing through the terminal of the OLED is stably maintained.

Accordingly, when the operation voltage auto-adjustable AMOLED circuit and auto-adjusting method thereof described in the embodiment of the present invention is provided, the current passing through the terminal of the OLED is sensed to automatically adjust the voltage applied thereto, and the current passing through the terminal of the OLED is stably maintained.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Moreover, each embodiment described and illustrated herein includes its complementary conductivity type embodiment as well.

Figure 2A:
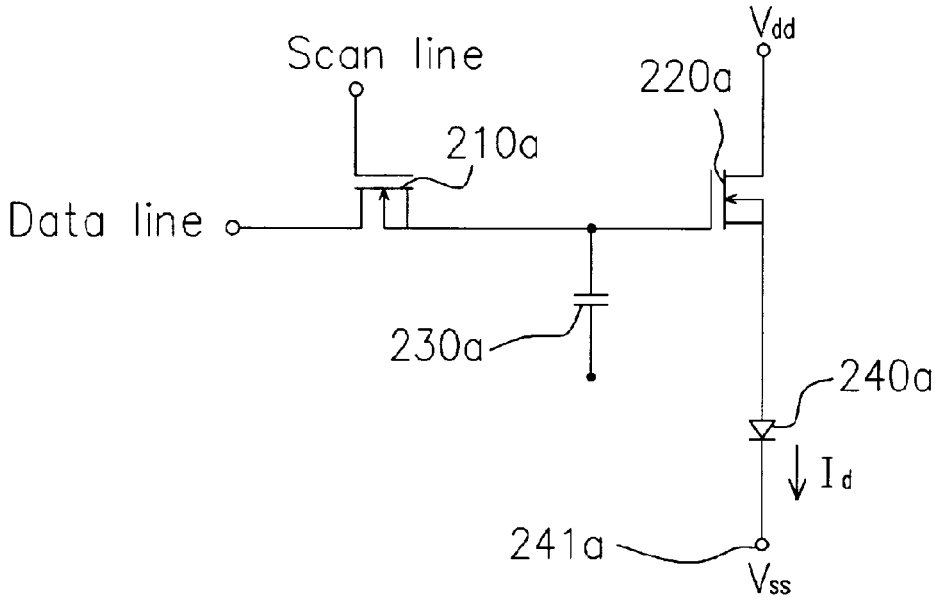
FIG. 2A to 2D are diagrams illustrating pixel driving circuits of AMOLED display panel of preferred embodiments of the present invention.

FIG. 2A is a diagram illustrating a pixel driving circuit of an AMOLED display panel of a preferred embodiment of the invention. Referring to FIG. 2A, a pixel of an AMOLED display panel includes a first TFT 210*a*, a second TFT 220*a*, a capacitor 230*a* and an OLED 240*a*. In FIG. 2A, the gate of the first TFT 210*a* is connected to a scan line, the drain of the TFT 210*a* is connected to a data line, and the source of the TFT 210*a* is connected to capacitor 230*a* and the gate of the second TFT 220*a*. The drain of the second TFT 220*a* is connected to a positive power Vdd, the source of the second TFT 220*a* is connected to t the anode of the OLED 240*a*, and a cathode 241*a* of the OLED 240*a* is connected to a negative power Vss.

As described above, the brightness of the OLED 240*a* is proportional to the current Id passing through the OLED 240*a*, and the current Id can be described by equation (1). When the scan line of the pixel is activated, the first TFT 210*a* is turned on in order to transmit the voltage of the data line to the gate of the second TFT 220*a*, and a gate voltage Vg of the second TFT 220*a* is achieved. If the voltage across the OLED 240*a* is Voled, then the voltage Vgs between the gate and the source of the second TFT 220*a* will become: Vgs=Vg Vs=Vg (Vss+Voled)

Because of the threshold voltage Vth of the second TFT 220*a* is known, according to the equation (1), the voltage value of the data line can be decided according to the brightness required.

Figure 1:
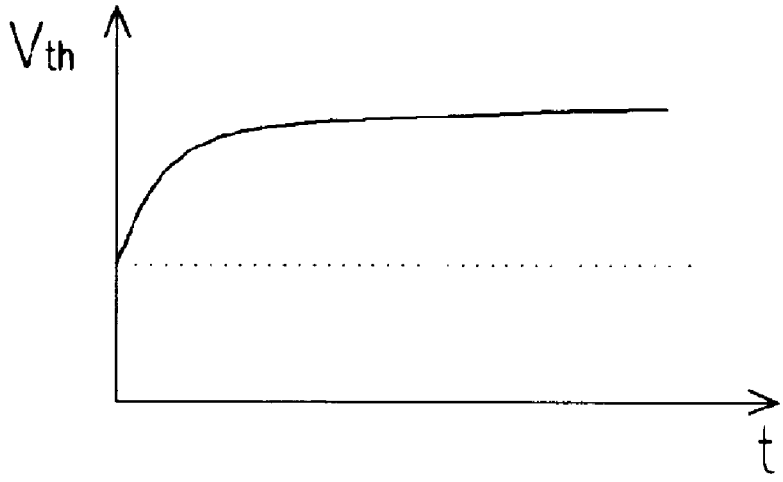
FIG. 1 is a diagram illustrating a curve of a threshold voltage of a TFT as a function of operation time.

However, referring to FIG. 1, when the threshold voltage Vth of the second TFT 220*a* increases along with the operating time, the current Id passing through the OLED 240*a* will decrease according to the equation (1). Therefore the performance of the brightness of the OLED 240*a* is reduced, and thus the lifetime of the device is reduced.

Figure 3:
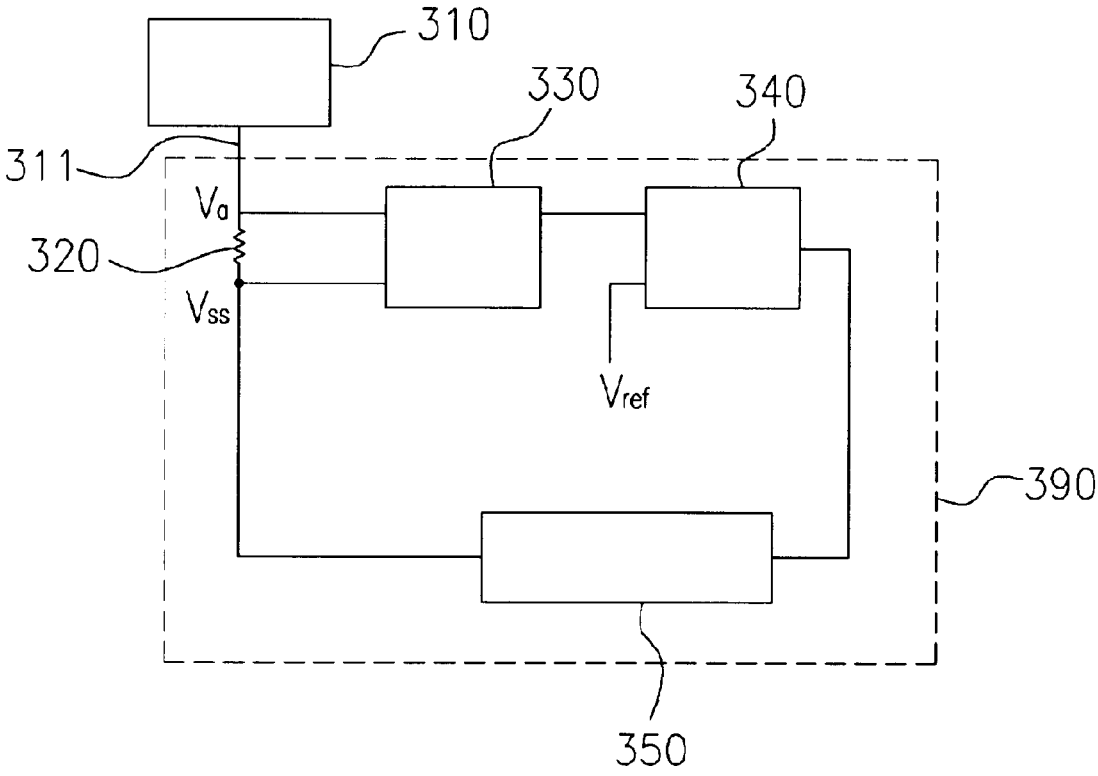
FIG. 3 is a block diagram illustrating a circuit of an AMOLED of a preferred embodiment of the present invention.

FIG. 3 is a block diagram illustrating a circuit of an AMOLED of a preferred embodiment of the present invention. Referring to FIG. 3, the terminal 311 of the OLED of the display panel 310 of the AMOLED is connected to an auto-adjusting circuit 390 of the operation voltage for sensing the circuit of the terminal 311 of the OLED. The voltage Vss applied to the terminal 311 of the OLED is adjusted according to the sensed circuit of the terminal 311 in order to maintain the stability of the current passing through the terminal 311 of the OLED.

Referring to FIG. 3, the auto-adjusting circuit 390 includes a resistor 320, a subtracting circuit 330, a comparing circuit 340 and a digital processor 350. The resistor 320 is provided for generating a sensing voltage Va according to the detected current of the terminal 311 of the OLED. The subtracting circuit 330 is provided for computing a voltage difference between the sensing voltage Va and the voltage Vss applied to the terminal 311 of the OLED. The voltage difference Va Vss obtained above is compared to a reference voltage Vref by the comparing circuit 340, and a control signal is provided according to the compared result. The control signal is transmitted to the digital processor 350, and the voltage Vss applied to the terminal 311 of the OLED is adjusted automatically according to the control signal, thus the stability of the current passing through the terminal 311 of the OLED is maintained. Therefore, when the current passing through the terminal 311 is lowered, the voltage Vss will be decreased. On the other hand, when the current pass through the terminal 311 is increased, the voltage Vss will be increased.

In order to reduce the effect of the resistor 320 to the driving circuit, the resistance of the resistor 320 should be as low as possible. For example, the resistance of the resistor is less than about 10 ohm. As to the reference voltage Vref, the reference voltage Vref is computed according to a standard value of the current passing through the terminal 311 of the OLED. And the voltage Vss applied to the terminal 311 of the OLED is adjusted according to the sensed circuit of the terminal 311 in order to maintain the stability of the current passing through the terminal 311 of the OLED.

Figure 2B:
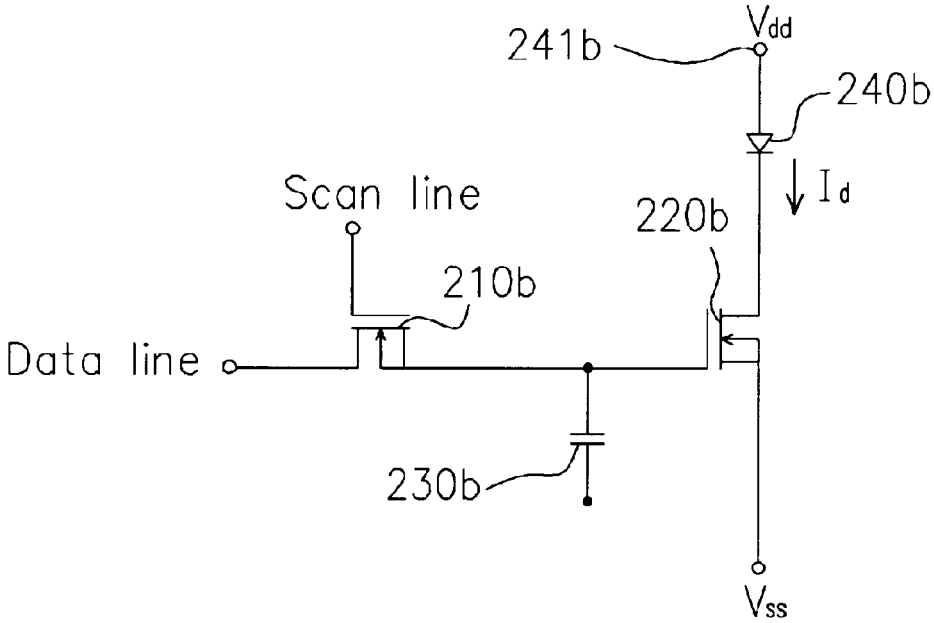

FIG. 2B is a diagram illustrating another pixel driving circuit of an AMOLED display panel of a preferred embodiment of the invention. The function of the circuit shown in FIG. 2B is similar to that in FIG. 2A. Comparing FIG. 2B with FIG. 2A, the major difference between the two circuits is that, in FIG. 2A, the anode of the OLED 240*a* is connected to the source of the TFT 220*a*, but in FIG. 2B, the cathode of the OLED 240*b* is connected to the drain of the TFT 220*b*. The circuit shown in FIG. 2B can also be provided for driving an AMOLED display panel.

Figure 2C:
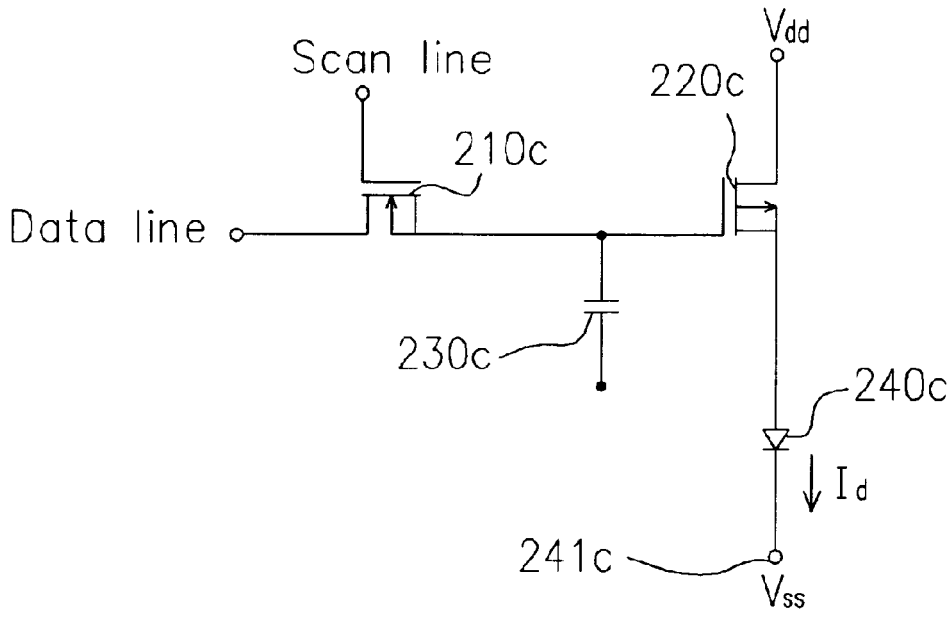

Likewise, FIG. 2C is a diagram illustrating another pixel driving circuit of an AMOLED display panel of a preferred embodiment of the invention. The function of the circuit shown in FIG. 2C is also similar to that in FIG. 2A. Comparing FIG. 2C with FIG. 2A, the major difference between the two circuits is that, in FIG. 2A, the TFT 220*a* is a p-type TFT, but in FIG. 2C, the TFT 220*c* is a n-type TFT. The circuit shown in FIG. 2C can also be provided for driving an AMOLED display panel.

Figure 2D:
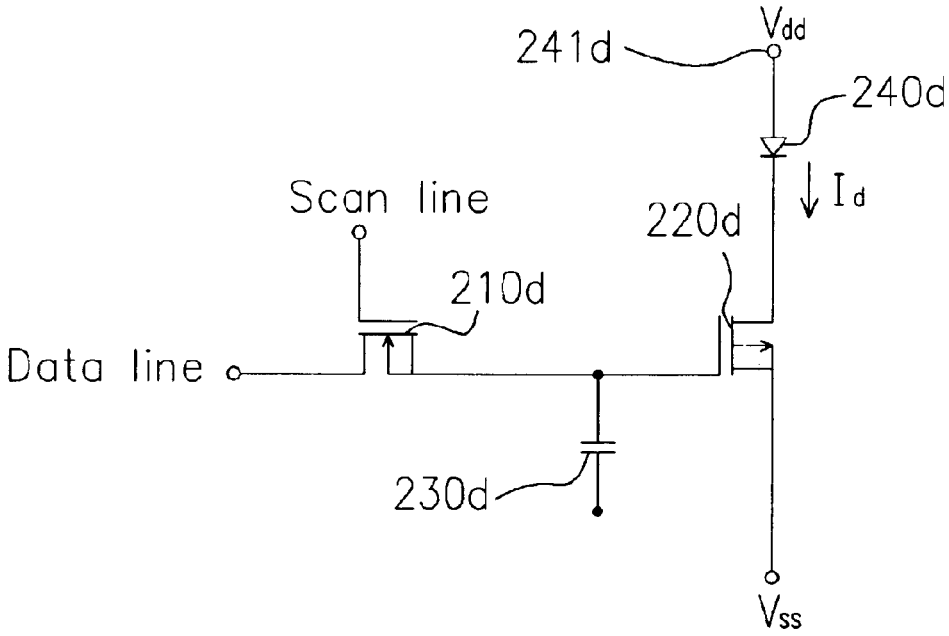

FIG. 2D is a diagram illustrating another pixel driving circuit of an AMOLED display panel of a preferred embodiment of the invention. The function of the circuit shown in FIG. 2D is similar to that in FIG. 2C. Comparing FIG. 2D with FIG. 2C, the major difference between the two circuits is that, in FIG. 2C, the anode of the OLED 240*c* is connected to the source of the TFT 220*c*, but in FIG. 2D, the cathode of the OLED 240*d* is connected to the drain of the TFT 220*d*. The circuit shown in FIG. 2D can also be provided for driving an AMOLED display panel.

According to the embodiment described above of the present invention, a method for automatically adjusting an operation voltage of an AMOLED is provided. The method includes sensing a current of the terminal of an OLED; and adjusting a voltage applied to the terminal of the OLED according to the sensed current of the terminal of the OLED automatically. Therefore the current passing through the terminal of the OLED is stably maintained.

Accordingly, when the operation voltage auto-adjustable AMOLED circuit and auto-adjusting method thereof described in the embodiment of the present invention is provided, the current passing through the terminal of the OLED is automatically adjusted and stably maintained. Moreover, the lifetime of the devices can also be extended.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A circuit for automatically adjusting an operation voltage of an active matrix organic light emitting diode ("AMOLED"), comprising:

a display panel of an AMOLED having a cathode terminal of an organic light emitting diode ("OLED"); and an auto-adjusting circuit connected to the cathode terminal of the OLED, wherein a current passing through the cathode terminal of the OLLED is detected by the auto-adjusting circuit, and a voltage applied to the cathode terminal of the OLED is adjusted by the auto-adjusting circuit according to the current detected.

2. The circuit of claim 1, wherein the auto-adjusting circuit comprising:

a resistor for generating a sensing voltage, wherein the sensing voltage is generated according to the detected current of the cathode terminal of the OLED;

a subtracting circuit connected to the resistor for computing a voltage difference between the sensing voltage and the voltage applied to the cathode terminal of the OLED;

a comparing circuit for comparing the voltage difference with a reference voltage in order to provide a control signal; and a digital processor connected to the comparing circuit for automatically adjusting the voltage applied to the cathode terminal of the OLED according to the control signal.

3. The circuit of claim 2, wherein the resistance of the resistor is less than about 10 ohm.

4. The circuit of claim 2, wherein the reference voltage is computed according to a standard value of the current passing through the cathode terminal of the OLED.

5. A method for automatically adjusting an operation voltage of an active matrix organic light emitting diode ("AMOLED"), comprising:

sensing a current of the cathode terminal of a OLED; and adjusting a voltage applied to the cathode terminal of the OLED according to the sensed current of the cathode terminal of the OLED automatically.

* * * * *